US005890698A

United States Patent [19]

Domytrak

[11] Patent Number: 5,890,698

[45] Date of Patent: Apr. 6, 1999

[54] VALVE HAVING PRESSURE EQUALIZING CONDUIT

[76] Inventor: Walter Domytrak, 42 Rosewood Drive, Sherwood Park, Alberta, Canada, T8A 0L9

[21] Appl. No.: 949,228

[22] Filed: Oct. 13, 1997

[51] Int. Cl.[6] ..... E21B 33/06

[52] U.S. Cl. ..... 251/1.1; 137/629

[58] Field of Search ..... 251/1.1, 172; 137/629

[56] References Cited

U.S. PATENT DOCUMENTS

| | | | |
|---|---|---|---|
| 2,092,452 | 9/1937 | Gilbert | 137/629 X |
| 4,066,128 | 1/1978 | Davis et al. | 166/315 |
| 4,230,185 | 10/1980 | Fredd | 166/332 |
| 4,278,130 | 7/1981 | Evans et al. | 166/332 |
| 4,289,165 | 9/1981 | Fredd | 137/625.32 |
| 4,406,328 | 9/1983 | Brooks | 166/332 |
| 4,535,852 | 8/1985 | Boyadjieff et al. | 175/170 |
| 4,575,045 | 3/1986 | Martin et al. | 137/629 X |
| 4,582,293 | 4/1986 | Jones | 251/1.1 X |

*Primary Examiner*—John Fox
*Attorney, Agent, or Firm*—Sheridan Ross P.C.

[57] ABSTRACT

Pressure can build up on one side of a valve bore sealing mechanism when it is closed. This can make the mechanism difficult to open. A bore network is provided which extends through the valve housing side wall from the inlet end of the valve bore to its outlet end. The network bypasses the sealing mechanism and its sealing areas. Needle valves, operative from outside the valve, are used to open or close the network. The network can be temporarily opened to enable pressure to equalize across the closed sealing mechanism, thereby freeing the mechanism so that it can be turned.

3 Claims, 4 Drawing Sheets

VALVE HAVING PRESSURE EQUALIZING CONDUIT

FIELD OF THE INVENTION

The invention relates to means for equalizing differential pressure across a closed valve bore sealing mechanism in a valve.

BACKGROUND OF THE INVENTION

The present invention has been developed in connection with a tubing blow-out preventer ("BOP") having a ball as a valve bore sealing mechanism. The invention will be described in connection with that particular form of valve. However, it is anticipated that the invention will have application to other valves, including other forms of plug valve and gate valves, in situations where controlled pressure equalization may be desirable.

The tubing BOP is a piece of equipment brought to a well in connection with service rig operations. It is mounted to the upper end of the tubing string projecting from the wellhead. It commonly has a truncated ball, having a through bore, which can be rotated through 90° to open or close the bore of the valve.

At the end of the working day, it is usual practice for the service rig crew to close the BOP to seal the tubing string. In some cases, considerable pressure (e.g. 2000 psi) can build up overnight in the tubing string. This pressure acts to press the ball upwardly against the upper seal ring of the valve housing. When the crew arrive the next day, the ball can be very difficult to turn. In many cases, a line and pump have to be tied to the top outlet of the BOP and pressure applied to the outlet side of the ball, to free it. This is time-consuming to carry out. Some inexperienced personnel don't understand the problem or what to do about it. This can result in delay until an experienced person arrives to organize pressure equalization.

There is therefore a problem of long standing for which no practical solution has been provided, as far as applicant is aware. It is the object of the invention to provide such a solution.

At this point, it is useful to describe a conventional tubing BOP having a ball as its bore sealing mechanism, such as the BOP, illustrated in FIG. 1. It comprises:

- A tubular housing comprising a lower body and an upper sub. The body is internally threaded at its lower end for connection with the tubing. The body and sub are threadably connected. The sub is internally threaded at its upper end;
- The housing side wall forms a through bore. This bore consists of an inlet bore and ball chamber formed by the body and an outlet bore formed by the sub;
- The housing includes lower and upper seal rings which bracket the ball. Each seal ring forms an annular seal area against which the ball seals;
- The ball has flat sides. A stem (not shown) is secured to one side of the ball for turning it;
- The ball forms an axial through bore extending parallel to its sides, for connecting the inlet and outlet bores of the housing;
- The seal rings carry external O-rings for sealing against the internal surface of the housing;
- A clearance is formed between the outer surface of the ball, external of the annular seal areas, and the internal surface of the housing; and

- A spring is positioned between the base of the lower seal ring and the housing, for biasing the lower seal ring and ball tightly against the upper seal ring, to preserve the annular seals.

The present invention is an improvement to a conventional valve, of which a tubing BOP, having a ball sealing mechanism, is representative. This improvement will now be described.

SUMMARY OF THE INVENTION

In accordance with the invention, a bore network is formed in the side wall of the housing. The network comprises a first bore connecting the inlet bore of the housing with the lower end of the chamber, at a point external of the lower annular seal area. A third bore connects the upper end of the chamber with the housing outlet bore, from a point external of the upper annular seal area. A second bore extends inwardly from the housing outer surface and connects with the first bore. A fourth bore extends inwardly from the housing outer surface and connects with the third bore. Suitable valves, operable from outside the housing, are threaded into each of the second and fourth bores and are operable to open and close each of the first and third bores. Needle valves are suitable for this purpose.

When pressure is to be equalized across the bore sealing mechanism, one opens the two needle valves, without removing them. Pressure is then transmitted through the first bore, chamber clearance and third bore from the inlet bore to the outlet bore, while the bore sealing mechanism remains closed. The mechanism is thereby freed for turning.

It will be noted that the upper end of the outlet bore will have to be closed in some fashion during equalization.

DESCRIPTION OF THE PREFERRED EMBODIMENT

Figure 1:
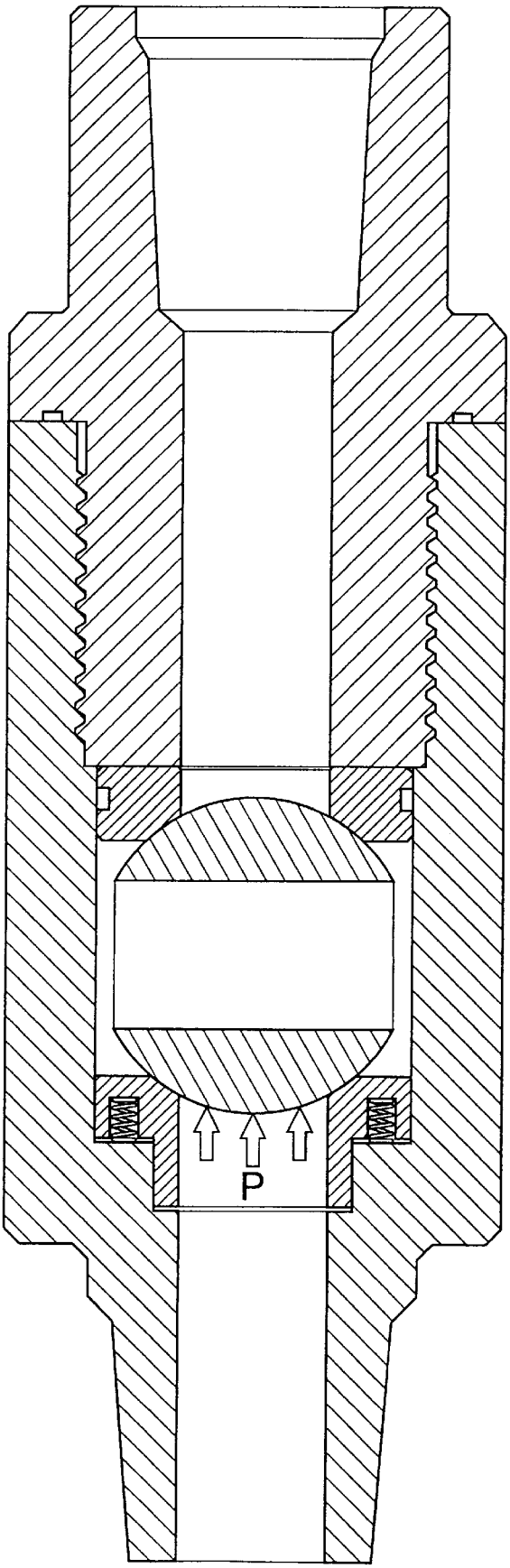
FIG. 1. (Prior Art)
FIG. 1 is a side sectional view of a conventional tubing BOP having a ball-type valve bore sealing mechanism, indicating pressure build-up with arrows.

The BOP 1 comprises a lower body 2 and upper sub 3. Although not shown, the body 2 is externally threaded at its bottom end 4 and the sub 3 is internally threaded at its top end 5. The body 2 and sub 3 are threadably joined by a connection 6. When united, the body 2 and sub 3 form a housing 7 having a side wall 8. The body 2 and sub 3 are generally tubular in configuration. The body 2 forms an inlet bore 9 and a chamber 10. The inlet bore 9 communicates with the chamber 10. The sub 3 forms an outlet bore 11 which communicates with the chamber 10. The inlet bore 9, chamber 10 and outlet bore 11 together constitute a through bore extending through the housing 7. A bottom seal ring 12 is positioned in the chamber 10 and is supported on a shoulder 13 formed by the body 2. The bottom seal ring 12 carries external O-rings 14, for sealing against the internal surface 15 of the housing 7. A spring 16 is positioned in a groove 17 formed in the bottom surface of the bottom seal ring 12. The spring 16 acts against the housing shoulder 13 to urge the seal ring 12 upwardly. A top seal ring 18 is positioned in the upper end of the chamber 10. The top seal ring 18 abuts the end face 19 of the upper sub 3. Top seal ring 18 carries external O-rings 20 for sealing against the housing internal surface 15. The bottom and top seal rings 12, 18 respectively form annular seal areas 21, 22. The ball 23 is positioned in the chamber 10, is bracketed by the bottom and top seal rings 12, 18 and contacts the annular seal areas 21, 22. The spring 16 urges the bottom seal ring 12, ball 23 and top seal ring 18 upwardly against the sub end face 19. The ball 23 and seal areas 21, 22 engage and seal when so pressed together. A clearance 24 is formed between the outer surface 25 of the ball 23 and the housing internal surface 15. The ball 23 forms an axial bore 26. In an open mode, the axial bore 26 registers with the inlet and outlet bores 9, 11 and forms a through passageway extending longitudinally through the housing 7. In a closed mode, the bore 26 is out of register with the bores 9, 11. In the latter case, the ball 23 interrupts or closes the housing through bore. The seals formed between the ball 23 and the seal areas 21, 22 prevent communication through the clearance 24.

In accordance with the invention, a bore network is formed in the housing side wall 8. The network comprises a right-angled first bore 30 which connects the inlet bore 9 with the chamber 10, external of the lower annular seal area 21. A second bore 31 extends inwardly from the housing external surface 32 and intersects the first bore 30 at the right angle turn 33. Second bore 31 is internally threaded. A needle valve 34 is screwed into second bore 31 and is operative to open or close first bore 30. A tubular lock nut 35 limits how far the needle valve 34 can back out. A right-angled third bore 36 extends upwardly through the top seal ring 18 and upper sub 3 and turns at 37 to communicate with the outlet bore 11. Third bore 36 communicates with chamber 10 external of the annular upper seal area 22. A fourth bore 38 extends inwardly from the housing surface 32 and intersects the third bore 36 at the turn 37. The fourth bore 38 is internally threaded and a needle valve 39 is screwed into it and is operative to open and close third bore 36. A lock nut 40 secures the needle valve 39 in place.

Third bore 36 has two portions, namely portion 36*a* extending through the seal ring 18 and portion 36*b* extending through the upper sub 3. To ensure that they communicate, the inlet of bore portion 36*b* is in the form of a groove 40 extending the length of sub end face 19. See FIGS. 3 and 4. A pair of grooves 41, 42 are provided on each side of groove 40. O-rings 43, 44 are positioned in grooves 41, 42 to isolate groove 40.

To equalize pressure across the closed ball 23, the upper end of sub 3 is closed, as with a valve. The two needle valves 34, 39 are then opened. Pressure is transmitted from inlet bore 9, through first bore 30, clearance 24, and third bore 36 to outlet bore 11. The ball 23 should then turn freely.

The invention resides in the combination of parts hereinbefore described, illustrated in the drawings and particularly pointed out in the appended claims. It is to be understood that various changes in minor details of the structure may be made without departing from the spirit and advantages of the invention.

The emodiments of the invention in which an exclusive property or privilege is claimed are defined as follows:

1. In a valve comprising a housing having a side wall having an external surface and forming a through bore, said bore comprising in sequence an inlet bore section, a valve chamber having inlet and outlet ends and an outlet bore section, said valve further including a bore sealing mechanism positioned in the chamber and operative to open and close the bore, said housing forming inlet and outlet annular seal areas at the junction of the inlet bore section and chamber and the outlet bore section and chamber, said bore sealing mechanism being operative to seal against the seal areas in a closed mode to interrupt the through bore and to provide a bore connecting the inlet and outlet bores in an open mode, the improvement comprising;

said side wall forming a first bore extending longitudinally through the side wall and connecting the inlet bore section with the inlet end of the chamber external of the inlet seal area;

said side wall forming a second bore extending transversely thereof and connecting the external surface of the side wall with the first bore;

a first valve, for threadably securing in the second bore, operative to open and close the first bore, said first valve being operable from outside the valve;

said side wall forming a third bore extending longitudinally through the side wall and connecting the outlet bore section with the outlet end of the chamber external of the outlet seal area;

said side wall forming a fourth bore extending transversely thereof and connecting the external surface of the side wall with the third bore; and a second valve, for threadably securing in the fourth bore, operative to open and close the third bore, said second valve being operable from outside the valve;

so that the first and second valves may be opened to equalize pressure across the bore sealing mechanism between the inlet bore section and the outlet bore section.

2. In a blow-out preventer ("BOP") for controlling the tubing string of a wellhead, said BOP comprising a housing having a side wall having an external surface and forming a through bore, said bore comprising in sequence an inlet bore section, a valve chamber having inlet and outlet ends and an outlet bore section, said assembly further including a ball valve member positioned in the chamber and operative to open and close the bore, said ball valve member having a clearance with the housing, said housing including inlet and outlet seal rings bracketing the ball valve member, said inlet seal ring forming an annular first seal area against which the ball valve member seals, said outlet seal ring forming an annular second seal area against which the ball valve member seals, the improvement comprising:

said side wall forming a first bore extending through the side wall and connecting the inlet bore section with the inlet end of the chamber external of the first seal area;

said side wall forming a second bore extending transversely thereof and connecting the external surface of the side wall with the first bore;

a first needle valve, for threadably securing in the second bore, operative to open and close the first bore, said first needle valve being operable from outside the valve assembly;

said side wall forming a third bore extending through the side wall and connecting the outlet bore section with the outlet end of the chamber external of the outlet seal area;

said side wall forming a fourth bore extending transversely thereof and connecting the external surface of the side wall with the third bore; and a second needle valve, for threadably securing in the fourth bore, operative to open and close the third bore, said second needle valve being operable from outside the valve assembly;

so that the needle valves may be opened to equalize pressure across the ball valve member through the first bore, clearance and third bore.

3. The improvement as set forth in claim 2 wherein:

the housing comprises a lower body and a top sub, the outlet seal ring is bracketed between the ball valve member and the top sub, the outer seal ring forms an initial section of the third bore, the top sub having an inner end face forming an annular inlet groove which is the inlet to the end section of the third bore, said end face forming inner and outer annular seal grooves, one on each side of the inlet groove, for retaining O-rings to seal the inlet groove.

* * * * *

UNITED STATES PATENT AND TRADEMARK OFFICE

CERTIFICATE OF CORRECTION

PATENT NO. : 5,890,698
DATED : April 6, 1999
INVENTOR(S) : Domytrak

Figure 2:
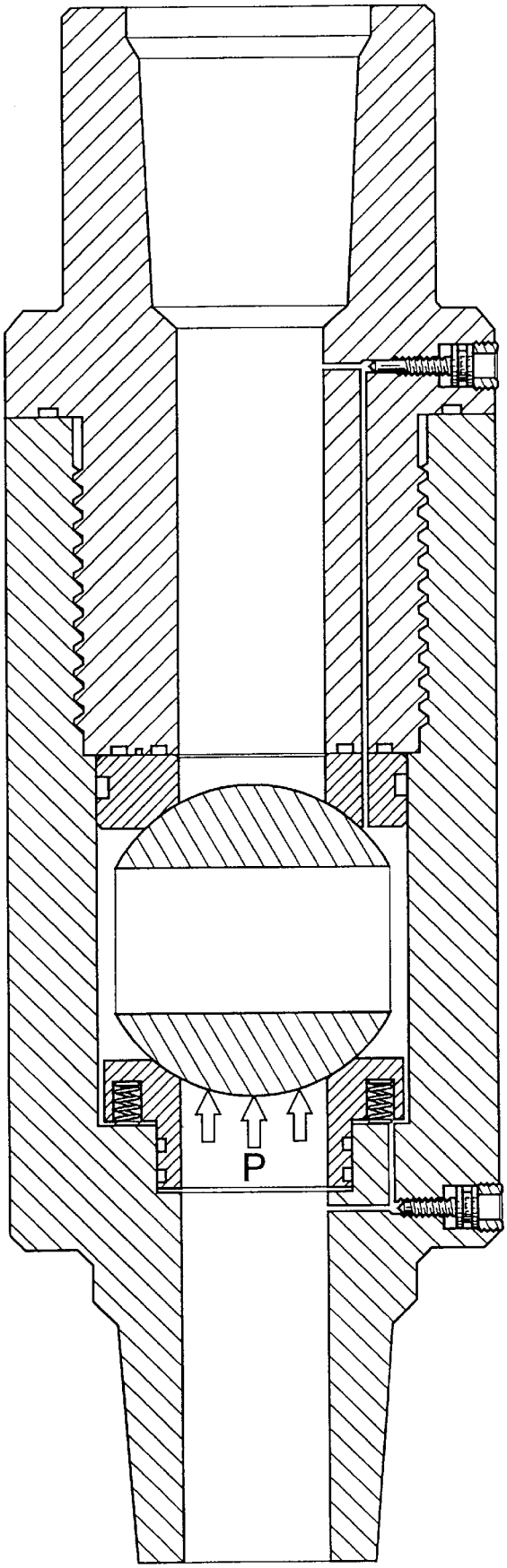
FIG. 2 is a view similar to that of FIG. 1, showing a bore network and control valves incorporated into the BOP in accordance with the invention.

It is certified that error appears in the above-identified patent and that said Letters Patent is hereby corrected as shown below:

Figure 2. should be deleted entirely and replaced with the Figure in Attachment I. labeled Fig. 2.

Figure 3:
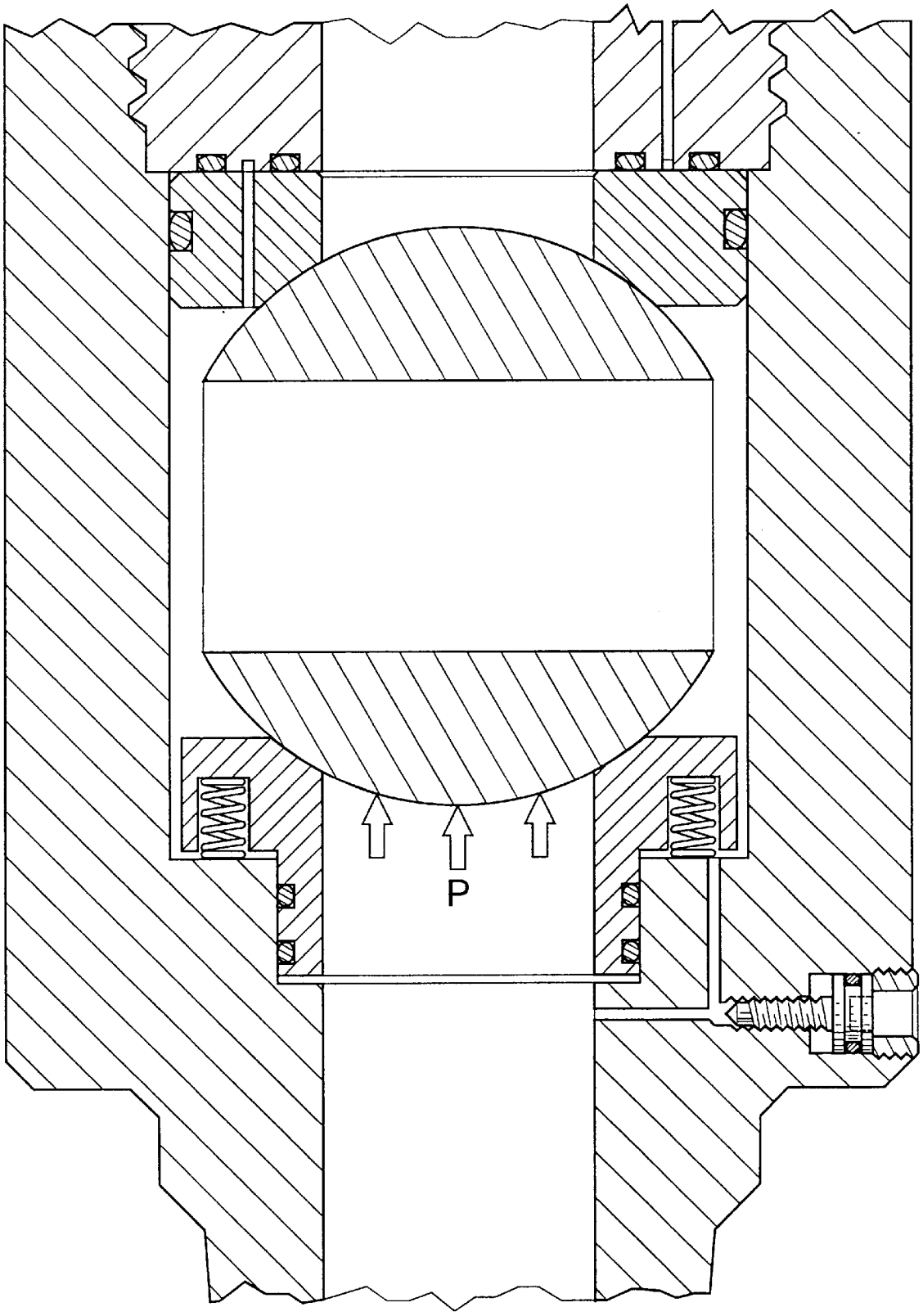
FIG. 3 is an expanded side sectional view of the assembly of FIG. 2.

Figure 3. should be deleted entirely and replace with the Figure in Attachment II. labeled Fig. 3.

Figure 4:
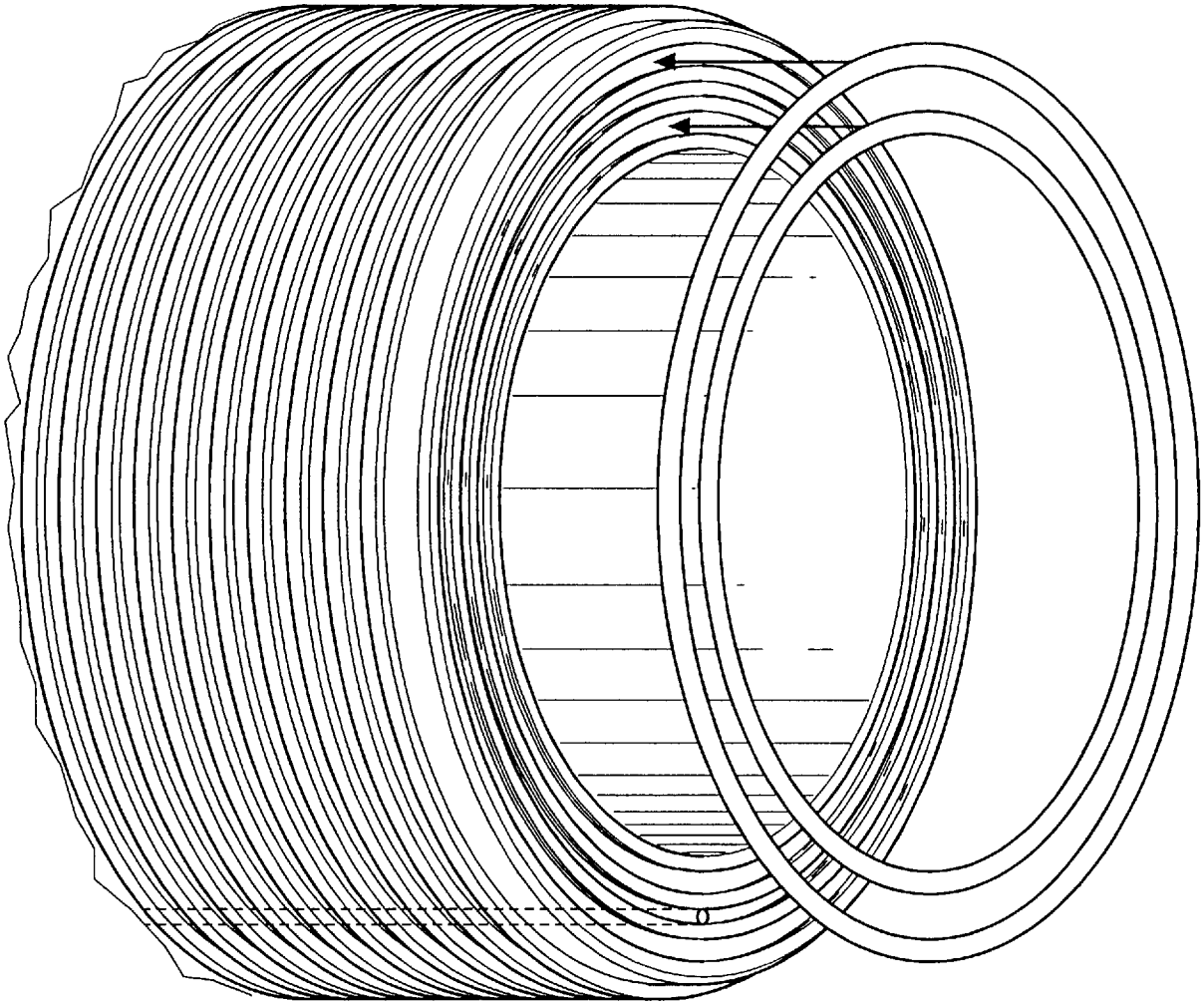
FIG. 4 is an upended perspective view showing the threaded end of the upper sub.

Figure 4. should be deleted entirely and replaced with the Figure in Attachment III. labeled Fig. 4.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*